US006237323B1

(12) United States Patent
Ojiro et al.

(10) Patent No.: US 6,237,323 B1
(45) Date of Patent: May 29, 2001

(54) GAS TURBINE COMBUSTOR BY-PASS VALVE DEVICE

(75) Inventors: Yasuhiro Ojiro; Koichi Akagi; Yoichi Iwasaki; Jun Kubota; Sunao Umemura, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/365,894

(22) Filed: Aug. 3, 1999

(30) Foreign Application Priority Data

Aug. 3, 1998 (JP) ..... 10-218975
Oct. 26, 1998 (JP) ..... 10-304037

(51) Int. Cl.[7] ..... F23R 3/26
(52) U.S. Cl. ..... 60/39.23
(58) Field of Search ..... 60/39.07, 39.092, 60/39.23, 226.3

(56) References Cited

U.S. PATENT DOCUMENTS 2,924,938 * 2/1960 Herbert ..... 60/39.23
5,548,951 * 8/1996 Mumford et al. ..... 60/39.23
5,557,920 * 9/1996 Kain ..... 60/39.23

* cited by examiner

*Primary Examiner*—Louis J. Casaregola
(74) *Attorney, Agent, or Firm*—Wenderoth, Lind & Ponack, L.L.P.

(57) ABSTRACT

Gas turbine combustor by-pass valve device for opening and closing by-pass valve is improved to control uniformly air supply into combustion area for appropriate combustion. Drive shaft 21 for opening and closing driven by-pass valve 20 is provided in turbine casing 010 where outside obstruction is located to interfere with projecting drive shaft 09. The driven shaft 21 is made in short length to be provided in the turbine casing 010. Adjacent main driving shaft 23 for opening and closing main driving by-pass valve 22 is provided adjacently to the driven shaft 21. Link mechanism 26 is provided between the adjacent main driving shaft 23 and the driven shaft 21, thereby rotary movement of adjacent main driving shaft 23 driven by outside drive means via the drive shaft 09 is transmitted to the driven shaft 21 and thus to the driven by-pass valve 20. Thus, partial drive shafts 09 are made shorter not to project outside of the turbine casing 010 to interfere with outside obstruction and still all the by-pass valves 08 provided along circumferential direction of the turbine casing 010 can be operated to be opened and closed uniformly.

6 Claims, 8 Drawing Sheets

GAS TURBINE COMBUSTOR BY-PASS VALVE DEVICE

BACKGROUND OF THE INVENTION

1. Field of the Invention

The present invention relates generally to a by-pass valve device used in a gas turbine combustor and more specifically to a by-pass valve for controlling a compressed air flow rate to be supplied into a combustion area of a tail tube downstream side so as to obtain an appropriate fuel/air ratio for a good combustion efficiency and for preventing foreign matters from coming into the gas turbine combustor for a smooth operation thereof.

2. Description of the Prior Art

As shown in FIG. 9, in a gas turbine combustor 01, fuel F is jetted into a combustor inner tube 02 from a fuel nozzle 03 to be led into a combustor tail tube 05. At the same time, compressed air PA discharged from a compressor 04 is led into the combustor tail tube 05 for combustion in a combustion area downstream of the combustor tail tube 05 so that a high temperature high pressure combustion gas CG is generated. This combustion gas CG is set to a flow velocity and a flow direction of designed condition by a stationary blade 06 downstream of the combustion area to be supplied to a moving blade 07. Thus, the compressor 04 is driven and a surplus drive force is used outside.

The compressed air PA from the compressor 04 is also supplied into the combustor inner tube 02 so as to form a mixture with the fuel F supplied from a fuel nozzle for flame holding in the fuel nozzle 03. This mixture is fired as a holding flame.

Thus, the fuel F jetted from the fuel nozzle 03 is ignited by the holding flame in the combustor inner tube 02 and is supplied into the combustion area with a fuel rich concentration.

On the other hand, the compressed air PA, except that supplied into the combustor inner tube 02 as mentioned above, discharged from the compressor 04 into a turbine casing 010 is supplied into the combustor tail tube 05 via an opening provided within the turbine casing 010. A by-pass valve 08 is provided in the opening near the combustor tail tube 05 and the compressed air PA supplied into the combustion area through the opening has its flow rate controlled by opening and closing of the by-pass valve 08. Therefore, a mixing ratio of the fuel F supplied from the combustor inner tube 02 and the air PA is adjusted to such a ratio as is able to generate a combustion gas of the best combustion efficiency in the combustion area.

As shown in FIG. 10(*b*), the combustor tail tube 05 is provided in 20 pieces along the circumferential direction of the turbine casing 010, and the by-pass valve 08 is provided in one piece for each of the combustor tail tubes 05. The by-pass valve 08 is operated to be opened and closed by rotation of a drive shaft 09 provided for each of the by-pass valves 08.

That is, as shown in FIG. 9 and FIG. 10(*a*), which is a partially cut out perspective view of a mounting portion of the by-pass valve 08, the drive shaft 09 has its proximal end connected to an end portion of a stem of the by-pass valve 08 and the drive shaft 09 passes through the turbine casing 010 so that its distal end projects outside of the turbine casing 010. As shown in FIG. 10(*b*), the drive shaft 09 is arranged in 20 pieces radially around a central axis of the turbine casing 010.

An inner ring 011 is fixed to an outer circumferential surface of the turbine casing 010, and an outer ring 012 is provided on the inner ring 011 and is moveable by an actuator. The drive shaft 09 is connected at the distal end to a side surface of the outer ring 012 via a link mechanism. When the outer ring 012 is rotated on the inner ring 011, all the drive shafts 09 are rotated so that all the by-pass valves 08 are opened and closed in unison. Thus, the compressed air PA is supplied uniformly into the combustion area downstream each of the combustor tail tubes 05.

In the prior art gas turbine combustor 01, the by-pass valves 08 are opened and closed in unison for controlling the flow rate of the compressed air PA to be flown into the combustor tail tubes 05 provided in 20 pieces along the circumferential direction of the turn casing 010 so as to adjust the mixing ratio of the fuel F and the air PA to be supplied into the combustion area between the combustor tail tube 05 and the stationary blade 06 for a good generation of the high temperature high pressure combustion gas CG. As a result, the structure is made such that the drive shaft 09 for opening and closing the by-pass valve 08 projects outside of the turbine 010 and such that the drive shafts 09 of as many as 20 pieces are arranged with substantially equal pitches along the entire circumference of the turbine casing 010, as mentioned above, and this results in a problem.

That is, as shown in portion A of FIG. 10(*b*), in a type of the gas turbine casing 010 which is formed by an upper portion and a lower portion fastened so as to be integrated, a turbine casing horizontal flange 013 for fastening the turbine casing 010 and other like portions on the outer side of the turbine casing 010 interfere with some of the drive shafts 09 so that there arises a case at some positions where the drive shaft 09 for opening and closing the by-pass valve 08 can not be provided.

That is, the turbine casing horizontal flange 013, a by-pass pipe 014, etc. on the outer side of the turbine casing 010 prevent some of the drive shaft 09 from projecting outside of the turbine casing 010. Thus, the by-pass valve 08 provided in the corresponding portion within the turbine casing 010 can not be operated to be opened and closed by the drive shaft 09 which is operated from outside of the turbine casing 010.

Accordingly, the by-pass valve 08 which is provided in the circumferential position where the turbine casing horizontal flange 013 and the like interfere and can not be opened and closed by the drive shaft is set to a predetermined opening position prior to operation of the gas turbine and the operation is done continuously with this predetermined opening. Hence, in the combustion area of the specific combustor tail tube 05 of the gas turbine combustor 01, the combustion efficiency becomes worse which results in a problem that lower operation of the worse combustion efficiency is unavoidable for a whole of the gas turbine combustor 01.

Also, in order to solve this problem, if all the by-pass valves 08 provided in 20 pieces with equal pitches along the circumferential direction of the turbine casing 010 are constructed to be opened and closed uniformly so that the combustion in all the combustion areas downstream of the combustor tail tubes 05 is done efficiently to enhance the combustion efficiency as a whole of the gas turbine combustor 01, then such a structure in which all the drive shafts 09 for opening and closing the by-pass valves 08 are arranged so as to project outside of the turbine casing 010 is unavoidable. This results in the restrictions in the outside structure of the turbine casing 010 and creates a problem in the arrangement of a plant comprising the gas turbine combustor 01.

Also, in the gas turbine combustor 01, when the by-pass valve 08 is opened so that the air is led into the combustor tail tube 05 through a by-pass duct 015, foreign matters are liable to flow through the by-pass valve 08, which results in a problem that the gas turbine may be damaged thereby. That is, if supporting members of pipings and the like in the combustor are damaged by vibration, or if bolts, nuts and the like loosen to scatter, then foreign matters caused thereby enter the by-pass ducts 015 to be led into the gas turbine, which may result in serious damage in the gas turbine moving blade and stationary blade. In the prior art gas turbine, however, there has been taken no effective countermeasure for preventing the foreign matters from coming in the turbine while the by-pass valve 08 is opened.

SUMMARY OF THE INVENTION

As mentioned above, in the prior art, control of the ratio of fuel and air, what is called an air fuel ratio, in the combustion area of the gas turbine tail tube 05 has not been sufficient because the partial by-pass valves 08 located in the portion of the turbine casing 010 where obstructions, such as the turbine casing horizontal flange 013, on the outer side of the turbine casing 010 interfere with the drive shaft 09 projecting outside cannot be operated to be opened and closed.

Thus, in order to solve this problem, it is a first object of the present invention to provide a gas turbine combustor by-pass valve device which is able to control the air fuel ratio uniformly in the combustion area of each of the combustor tail tubes 05 so as to obtain an enhanced combustion efficiency by employing a simple structure comprising a link mechanism for operating the partial by-pass valves 08 which have not been operated in the prior art.

Also, in the prior art gas turbine, the by-pass valve 08 is opened at the time of low load operation. If at this time a piping support member or the like is damaged to be broken by vibration fatigue etc. during operation, then foreign matters like metal fractions may come into the by-pass valve 08 and the by-pass duct 015. Likewise, by combustion vibration, a bolt, nut or the like may loosen to scatter from the fitted portion, or a measuring device, such as a sensor, may be sucked in. In such a case, these foreign matters may come into the combustion gas path of the gas turbine via the by-pass valve 08, the by-pass duct 015 and the combustor tail tube 05 to collide on the moving blade or stationary blade and, thus, create a danger of serious damage. In the prior art, there has been no appropriate countermeasure therefor, but accompanying the recent high temperature tendency of the gas turbine, there is a need to pay a sufficient attention to such a danger. Thus, it is a second object of the present invention to provide a gas turbine combustor by-pass valve device which is able to prevent foreign matters from coming into the by-pass valve 08 so as not to damage a performance of the by-pass valve. Thus, even in a case where the by-pass valve 08 is opened during operation time, the foreign matters are prevented from passing through the by-pass valve 08 and colliding with the moving blade and the stationary blade of the turbine to cause damage.

In order to attain the first object, the present invention provides the following aspects (1) to (4) as a first invention.

(1) A gas turbine combustor by-pass valve device provided on each of a plurality of combustor tail tubes arranged along a circumferential direction of a turbine casing for controlling air flow rate to achieve an appropriate combustion of fuel supplied into a combustion area downstream of each of the plurality of combustor tail tubes. The by-pass valve device is constructed such that a by-pass valve is opened and closed by a drive shaft having its proximal end connected to the by-pass valve and its distal (second) end projecting outside of the turbine casing and connected to a drive means.

The by-pass valve is either one of a driven by-pass valve or a main driving by-pass valve according to its position along a circumferential direction of the turbine casing. The drive shaft is either one of a driven shaft, a main driving shaft or an adjacent main driving shaft according to its position along the circumferential direction of the turbine casing. The driven by-pass valve is provided in the turbine casing at a place where an obstruction on an outer side of the turbine casing may interfere with the drive shaft. The driven shaft has its proximal end connected to the driven by-pass valve and its distal end positioned in the turbine casing.

(2) The main driving by-pass valve is provided in the turbine casing at a place where an option may not interfere with the drive shaft. The main driving shaft has its proximal end connected to the main driving by-pass valve, and its distal end projects outside of the turbine casing connected to the drive means.

(3) The adjacent main driving shaft is defined as one which is adjacent to the driven shaft out of the main driving shaft, and a link mechanism comprising two driving levers, two connecting members and a link bar is provided in the turbine casing.

(4) One of the driving levers has its proximal end fixed to the adjacent main driving shaft and has its distal end connected pivotally to one of the connecting members, and the distal end comprises a spring interposed therein. The other of the driving levers has its proximal end fixed to the driven shaft and has its distal end connected pivotally to the other of the connecting members, and the distal end comprises a spring interposed therein. The link bar has both ends connected to the two connecting members to link them to each other so that the driving lever and the connecting member make relative movement between each other corresponding to rotary movement of the drive shaft.

By employing the features of the first invention mentioned in aspects (1) to (4) above, the function and effect of the following (a) can be obtained:

(a) Rotary movement of the adjacent main driving shaft driven by the drive means is transmitted to the driven shaft for rotary movement thereof, and the driven by-pass valve is operated to be opened and closed synchronously while opening and closing of the main driving by-pass valve.

That is, the driven shy for rotting the driven by-pass valve provided in the turbine casing at the place where the outside obstruction of the turbine casing would interfere with the drive shaft if it projects outside thereof is provided in the turbine casing so as not to project outside of the turbine casing. Thus, the opening and closing operation of the driven by-pass valve can be done easily in the combustion area downstream of the combustor tail tube provided at the place where the outside obstruction is located, and the air whose flow rate is controlled for an appropriate combustion can be supplied into the combustion area, like in the main driving by-pass valve.

Also, the driven valve can be operated by the driven shaft which does not need to project outside of the turbine casing. Therefore, the outside structure of the turbine casing is not needed to be made in a specific form, but in an ordinary form and there is less restriction in the arrangement of the plant comprising the gas turbine combustor.

Further, in the link mechanism, each of the driving levers for moving the link bar has the spring interposed therein.

Furthermore, in the process of transmitting the driving force from the adjacent main driving shaft to the driven shaft and thus to the driven by-pass valve, the spring force presses the connecting portion between the driving lever and the link bar. Thus, even if Karman vortices are generated on the downstream side of the link bar by the compressed air flowing around the combustor tail tube arranged along the circumferential direction of the turbine casing, the link bar is relieved of the resonance with Karman vortices. That is, vibration of the link mechanism transmitted from the link bar is reduced and, moreover, abrasion in the pivot pin or the connection portion between the adjacent main driving shaft and the driven shaft caused by the generation of the vibration can be reduced.

Also, the present invention provides the following features of aspect (5) as a second invention in addition to the features of aspects (1) to (4) above:

(5) The driven shaft connected to the driven by-pass valve and the adjacent main driving shaft connected to the main driving by-pass valve are arranged in parallel with each other.

By employing the features of the second invention mentioned in aspect (5) in addition to aspects (1) to (4) above, the function and effect of the following (b) can be obtained in addition to those mentioned in (a) above:

(b) The driven shaft and the adjacent main driving shaft are arranged in parallel with each other. At least one of the driven shaft and the adjacent main driving shaft out of the drive shafts arranged radially along the radial direction of the turbine casing is biased from the radial direction. Thus, the rotation of the driven shaft and the adjacent main driving shaft is done in the same direction and in the mutually parallel planes. Even if the link mechanism is made in the single link type consisting of the driving levers and the connecting members, the driven shaft and the adjacent main driving shaft can be rotated easily by a small drive force of the drive means, the link mechanism can be made in a simple structure, no large load is generated during the operation time, and the device of a high reliability can be obtained.

Also, the present invention provides the following features of aspect (6) as a third invention in addition to the features of aspects (1) to (4) above:

(6) The link bar has a bent portion formed at an inclined between its first end lining to the adjacent main driving shaft, and its second end linking to the driven shaft. The bent portion is formed, for example, at an inclined so as to form a concentric arc with the arc plane in the circumferential direction of the turbine casing.

By employing the features of the third invention mentioned in aspect (6) in addition to aspects (1) to (4) above, the function and effect of the following (c) can be obtained in addition to those mentioned in (a) above:

(c) The bent portion is provided in the link bar so as to be formed, for example, in such a shape that both ends of the link bar come to the position of the driven by-pass valve and the main driving by-pass valve driven by the adjacent main driving sift. Thus, both in the driven by-pass valve and in the main driving by-pass valve arranged along the circumferential direction of the turbine casing, there is no need to change the positions of the driven by-pass valve. Moreover, the driven shaft whose proximal end is connected to the stem of the driven by-pass valve can be made so as to have the shortest possible length. Thus, the drive force for rotating the driven shaft can be made smaller.

Also, the present invention provides the following features of aspect (7) as a fourth invention in addition to aspects (1) to (4) above:

(7) The link bar is formed of a tubular member, contains therein steel balls and is provided on its outer surface with a rib extending projectingly and at an inclined with respect to its axial direction, and the tubular member may be of a round or square cross sectional shape.

By employing the features of the fourth invention mentioned in aspect (7) in addition to aspects (1) to (4) above, the function and effect of the following (d) can be obtained in addition to those mentioned in (a) above:

(d) The steel balls are filled in the round type or square type tubular member, and the rib is provided on the outer surface of the tubular member projectingly and at an inclined with respect to the axial direction thereof. Thus, Karman vortices generated on the downstream side of the link bar by the compressed air flowing around the combustor tail tube arranged along the circumferential direction of the turbine casing can be reduced and the link bar is relieved of the resonance with Karman vortices. Also, even if vibration occurs in the link bar due to Karman vortices, it can be reduced by the friction forces of the steel balls filled in the tubular member, and transmission of the vibration to the link bar from outside cud be reduced.

Also, the present invention provides the following features of aspect (8) as a fifth invention in addition to aspects (1) to (4) above:

(8) The link mechanism is made in a double link mechanism constructed such that an intermediate joint is provided so as to have its first end connected pivotally via a pivot pin to the distal end of the driving lever so that the driving lever and the intermediate joint make relative movement between each other corresponding to rotary movement of the drive shaft. A rotary pin is provided so that the other end of the intermediate joint is connected pivotally to the link bar. Therefore, the link bar is rotated orthogonally with respect to the moving direction of the intermediate joint.

By employing the features of the fifth invention mentioned in aspect (8) in addition to aspects (1) to (4) above, the function and effect of the following (e) can be obtained in addition to those mentioned in (a) above:

(e) The link mechanism is made in the double link type mechanism so that the driven shaft and the adjacent main driving shaft both arranged radially along the radial direction of the turbine casing can be rotated smoothly. Especially, the opening and closing of the driven by-pass valve can be done substantially at the same time as the opening and closing of the main driving by-pass valve via the adjacent main driving shaft. Moreover, this is done with the same degree of opening, or in other words, all the by-pass valves provided for the plurality of the combustor tail tubes arranged along the circumferential direction of the gas turbine casing are opened and closed uniformly at the same time. Hence, the air whose flow rate is controlled for effecting an appropriate combustion can be supplied and a gas turbine combustor which has excellent combustion efficiency and is able to generate a large drive force can be obtained.

Further, in order to attain the second object, the present invention provides the following aspects (9) to (11) as a sixth to eighth inventions, respectively:

(9) A gas turbine combustor by-pass valve device comprising an air by-pass duct and a by-pass valve provided in an inlet portion of the air by-pass duct to be opened and closed by rotation of a drive shaft A perforated plate is provided on a front side or a back side of the by-pass valve.

(10) The perforated plate is a punching metal.

(11) The perforated plate is provided so as to cover the front side of the by-pass valve.

By employing the features of the sixth to the eighth inventions mentioned in aspects (9) to (11) above, the function and effect of the following (f) can be obtained:

(f) The perforated plate is provided on the front side or on the back side of the bypass valve. Thus, when the by-pass valve is opened so that the air is led into the combustor, the air flows easily through a multiplicity of holes of the perforated plate. However, foreign matters, such as metal fractions, bolts and nuts, cannot pass through the perforated plate, because the holes bored therein have smaller sizes than the usual foreign matters, for example, the size of about 10 mm or less. Accordingly, there occurs no case where these metal fractions, bolts, nuts or the like of a size smaller than the holes can enter the combustion gas path of the gas turbine, and a safe operation of the gas turbine can be attained. Further, the punching metal may be used as the perforated plate.

Also, the present invention provides the features of aspect (9) above in addition to the features mentioned in aspects (1) to (4) above and by employing these features together, the combined function and effect mentioned in (a) and (f) can be obtained.

BRIEF DESCRIPTION OF THE DRAWINGS

FIG. 8 is an entire front view of a portion in a gas turbine casing where the punching metal 41 or 47 is arranged, wherein FIG. 8 is a view from a gas turbine combustion gas path side toward a combustor side.

DESCRIPTION OF THE PREFERRED EMBODIMENTS

Figure 9:
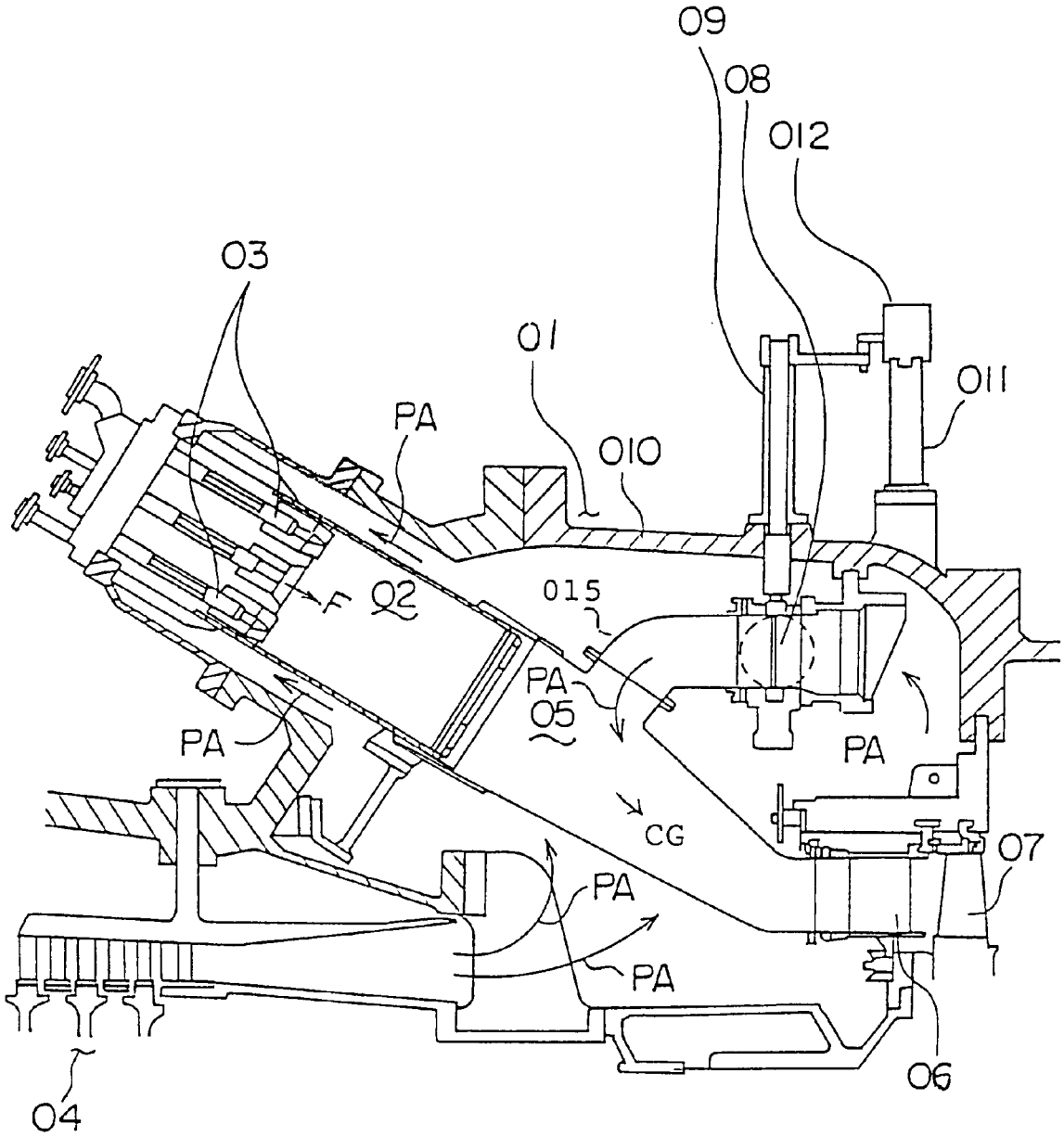
FIG. 9 (Prior Art)
FIG. 9 is a cross sectional side view of a gas turbine combustor in the prior art.

Herebelow, description will be made concretely on by-pass salve devices of embodiments according to the present invention with reference to figures. It is to be noted that the same or similar parts as those shown in FIGS. 9 and 10 are given the same reference numerals or letters in the figures, and description thereon will be omitted.

Figure 1:
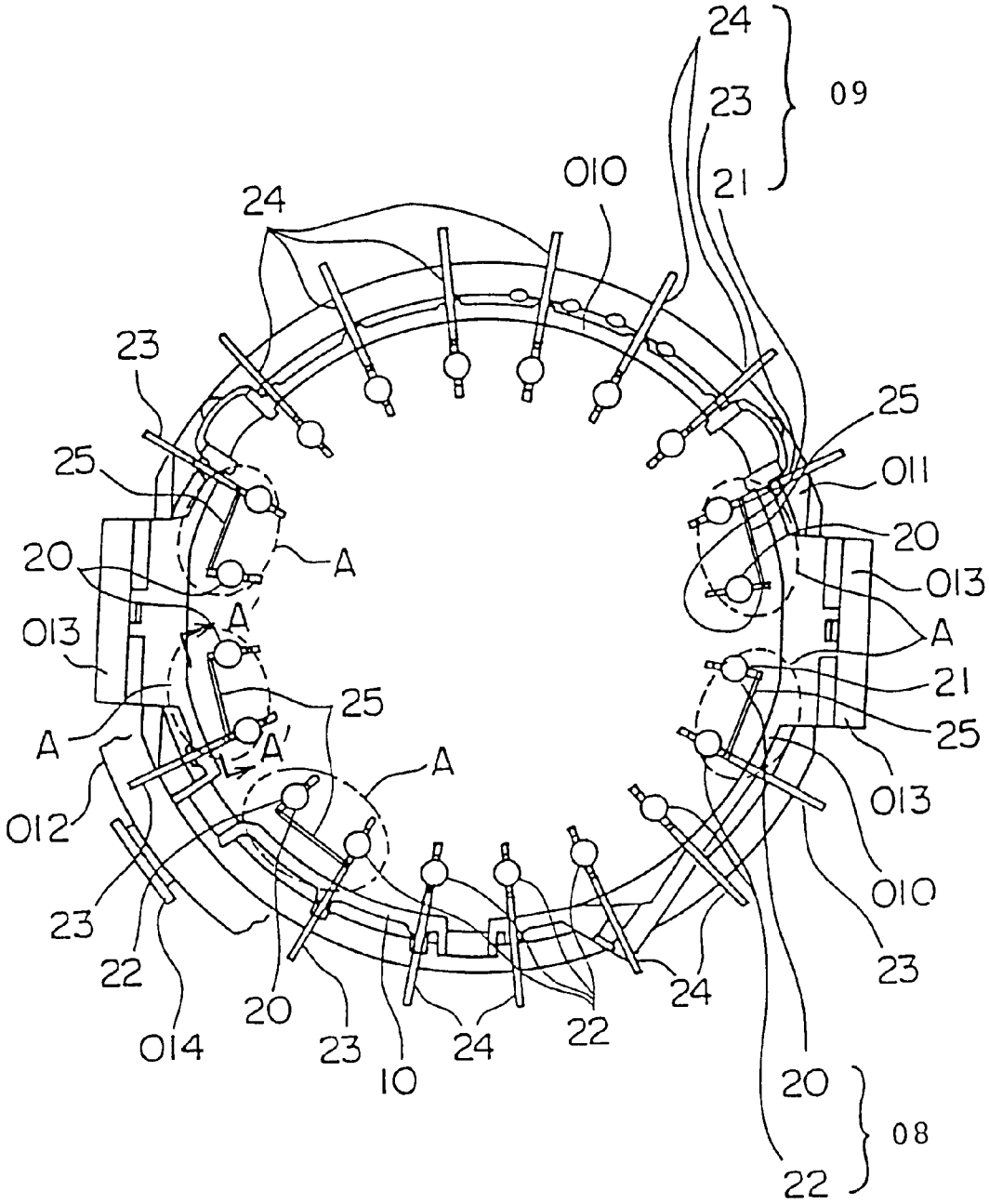
FIG. 1 is a front view, shown in the same direction indicated by arrow E—E of FIG. 10(*a*), of a gas turbine combustor by-pass valve device of a first embodiment according to the present invention.
Figure 10A:
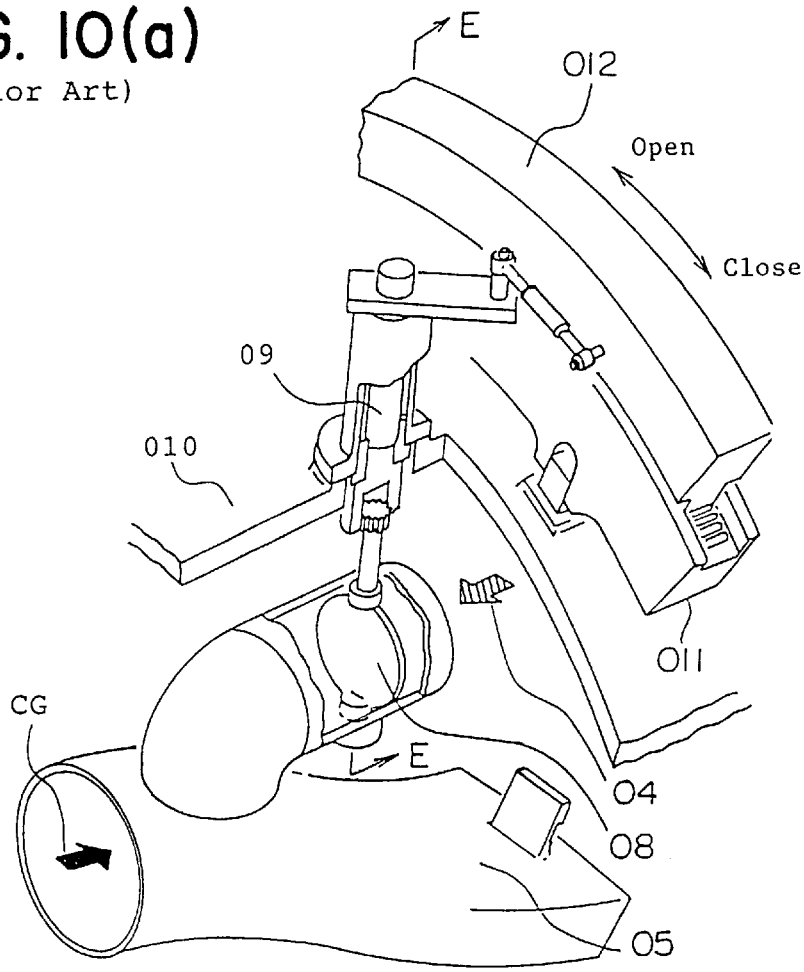
FIG. 10(a) (Prior Art)
FIG. 10 is an explanatory view of a by-pass valve device in the prior art, wherein FIG. 10(*a*) is a partially cut out perspective view, and FIG. 10 (*b*) is a front view seen in arrow E—E direction of FIG. 10(*a*).
Figure 10B:
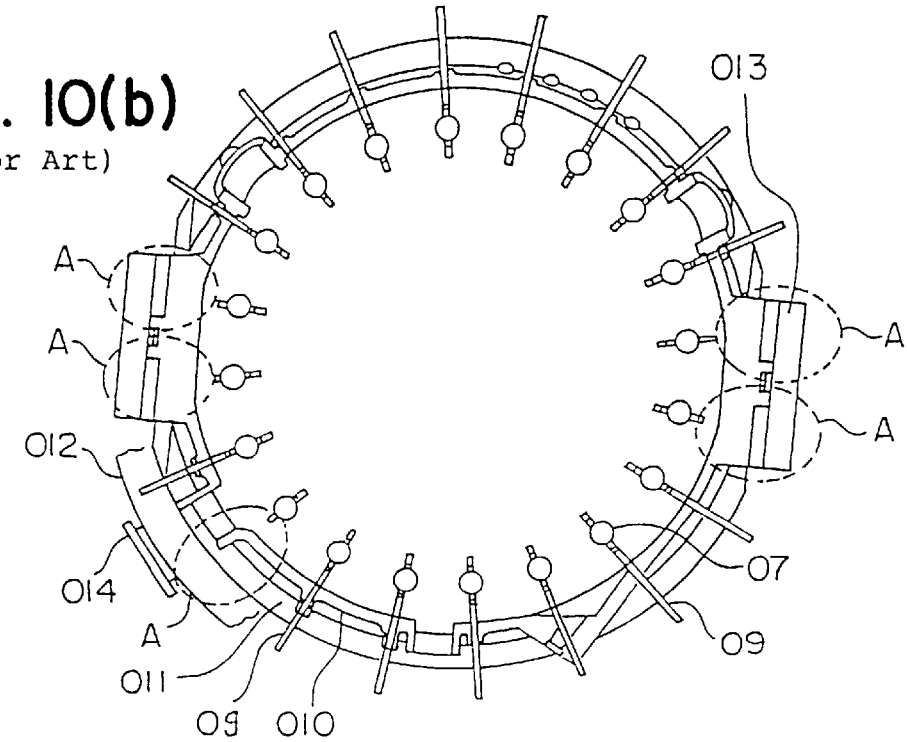
FIG. 10(b) (Prior Art)

FIG. 1 is a front view, seen in the same direction as arrow E—E of FIG. 10(*a*), of a gas turbine combustor by-pass valve device of a first embodiment according to the present invention.

As shown in FIG. 1, there are provided a turbine casing horizontal flange 013, a by-pass pipe 014, etc. on the outer side of a turbine casing 010, which would be obstructions interfering with a drive shaft 09 for opening and closing a valve body of a by-pass valve 08 if the drive shaft 09 is to pass through the turbine casing 010. In the turbine casing 010 and along a circumferential direction thereof, there are provided combustor tail tubes 05 in 20 pieces with equal pitches therebetween, that is, with an angle of 18° between tail tubes along the circumferential direction of the turbine casing 010, and the by-pass valve 08 is provided in an opening portion near each of the combustor tail tubes 05.

There are provided three types of the drive shaft 09, that is, a main driving shaft 24, an adjacent main driving shaft 23 and a driven shaft 21. Out of the drive shaft 09, the main driving shaft 24 and the adjacent main driving shaft 23 are provided in the place where the obstructions are not located, and the driven shaft 21 is provided in the place where the obstructions are located. Also, there are provided within the turbine casing 010 two types of by-pass valves 08, that is, a main driving by-pass valve 22 and a driven by-pass valve 20. The driven by-pass valve 20 is one that cannot be directly operated by the main driving shaft 24 because of the obstructions but is operated by the driven shaft 21 via the adjacent main driving shaft 23. The driven shaft 21 for opening and closing the driven bypass valve 20 has a shorter length so that an upper end or distal end thereof is positioned within the turbine casing 010.

The main driving shaft 24 for opening and closing the main driving by-pass valve 22 is connected at its upper end to a side surface of an outer ring 012 which is movable on an outer circumferential surface of an inner ring 011. The inner ring 011 is fixed to the outer side of the turbine casing 010.

Thus, the main driving shaft 24 and the adjacent main driving shaft 23 are rotated corresponding to the movement of the outer ring 012 on the inner ring 011. Thus, the main driving by-pass valve 22 is opened and closed and the flow rate of compressed air PA supplied into the combustor tail tube 05 can be controlled, like in the prior art gas turbine combustor 01 shown in FIGS. 9 and 10.

Also, in addition to the mentioned main driving shaft 24 for opening and closing the main driving by-pass valve 22, the adjacent main driving shaft 23 as one of the main driving shafts 24 is provided adjacently to the driven shaft 21. In other words, the adjacent main driving shaft 23 is provided for opening and closing the main driving by-pass valve 22 provided adjacent to the driven by-pass valve 20 in the opening portion near the combustor tail tube 05, and the flow rate of the compressed air PA supplied into this combustor tail tube 05 is controlled thereby.

Figure 2A:
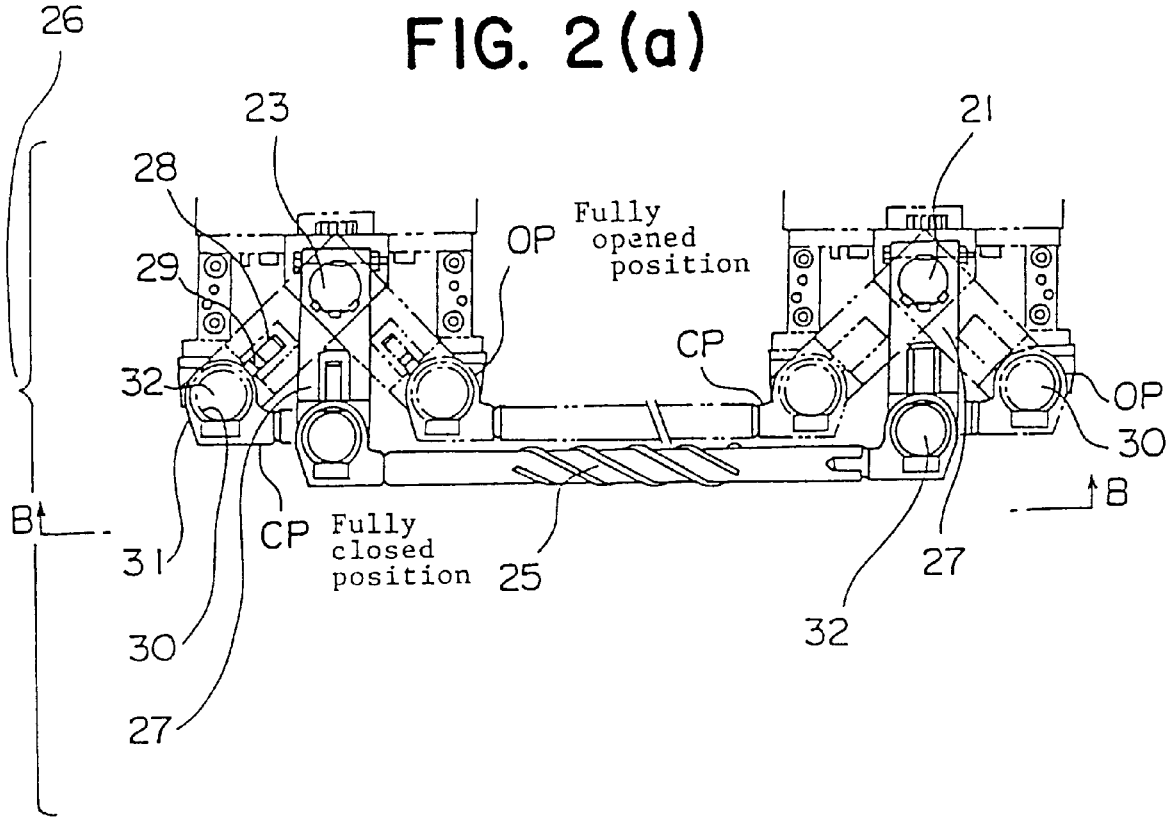
FIG. 2 is a detailed view of a link mechanism 26 for linking an adjacent main driving shaft 23 and a driven shaft 21 via a link bar 25, wherein FIG. 2(*a*) is a plan view seen in arrow A'—A' direction of FIG. 1, and FIG. 2(*b*) is a side view seen in arrow B—B direction of FIG. 2(*a*).
Figure 2B:
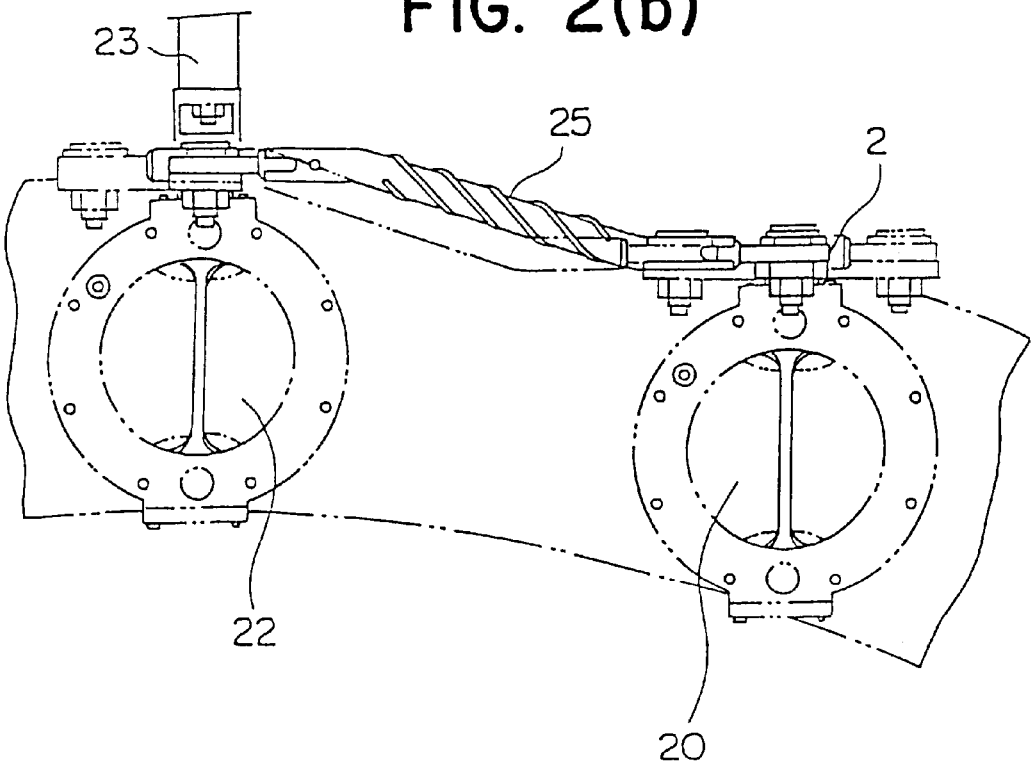

FIG. 2 is a detailed view of a link mechanism 26 for linking the adjacent main driving shaft 23 and the driven shaft 21 via a link bar 25. FIG. 2(*a*) is a plan view seen in arrow A'—A' direction of FIG. 1, and FIG. 2(*b*) is a side view seen in arrow B—B direction of FIG. 2(*a*).

The adjacent main driving shaft 23 is connected to an end portion of the driven shaft 21 via the link bar 25 within the turbine casing 010. While the adjacent main driving shaft 23 is rotated corresponding to the circumferential directional movement of the outer ring 012 for opening and closing the main driving by-pass valve 22, it also rotates the driven shaft 21 via the link bar 25 of the link mechanism 26 so that the driven by-pass valve 20 also may be opened and closed.

Contrary to the prior art case where the drive shafts 09 are provided radially around the central is of the turbine casing 010, as shown in FIG. 10(*b*), the adjacent main driving shaft 23 and the driven shaft 21 are arranged in parallel with each other, as shown in FIG. 2(*b*).

The link mechanism 26 as a unit consists of two portions. A first portion of link mechanism 26 is provided on the end portion of the driven shaft 21 positioned in the turbine casing 010, and a second portion of link mechanism 26 is provided on the portion of the adjacent main driving shaft 23 in the turbine casing 010. Both portions have basically the same design, so that only the second portion of link mechanism 26 provided on the adjacent main driving shaft 23 will be described for the purpose of simplicity.

The second portion of link mechanism 26 as one portion of the unit of the link mechanism 26 comprises a driving lever 27 and a connecting member 31. The driving lever 27 has its base portion or proximal end portion fixed to an outer circumferential surface of the adjacent main driving shaft 23 via an engaging pin, and has its other end or distal end portion provided with a pivot pin hole 30. The connecting member 31 is fitted to the driving lever 27 pivotally via a pivot pin 32, and a bushing is inserted into the pivot pin hole 30.

In the distal end portion having the pivot pin hole 30 of the driving lever 27, a spring holding section is bored along the axial direction of the driving lever 27 so as to open into the pivot pin hole 30, and a spring 28 is put in the spring holding section. A spring seat 29 is disposed between the bushing and the spring 28.

Thus, the link mechanism 26 is connected to the adjacent main driving shaft 23 and the driven shaft 21, respectively, and comprises the respective driving levers 27. Furthermore, link mechanism 26 is made in a single link type such that the connecting member 31 is connected pivotally via the pivot pin 32 to the distal end of the driving lever 27 so that the angle of the axial direction of the driving lever 27 with respect to the link bar 25 can change. Furthermore, the link bar 25 is provided between the respective distal ends of the diving levers 27 so that rotational movement of the adjacent main driving shaft 23 is transmitted to the driven shaft 21 so as to rotate the driven shaft 21 synchronously with the adjacent main driving shaft 23. Thus, the driven by-pass valve 20 connected to the base portion or the proximal end of the driven shaft 21 can be operated to be opened and closed.

The link bar 25 has a bent portion between its second end connected to the second portion of the link mechanism 26 of the adjacent main driving shaft 23 and its first end connected to the first portion of the link mechanism 26 of the driven shaft 21. The bent portion is formed so as to meet an arc plane which is concentric with a circumferential directional arc of the turbine casing 010.

Figure 3A:
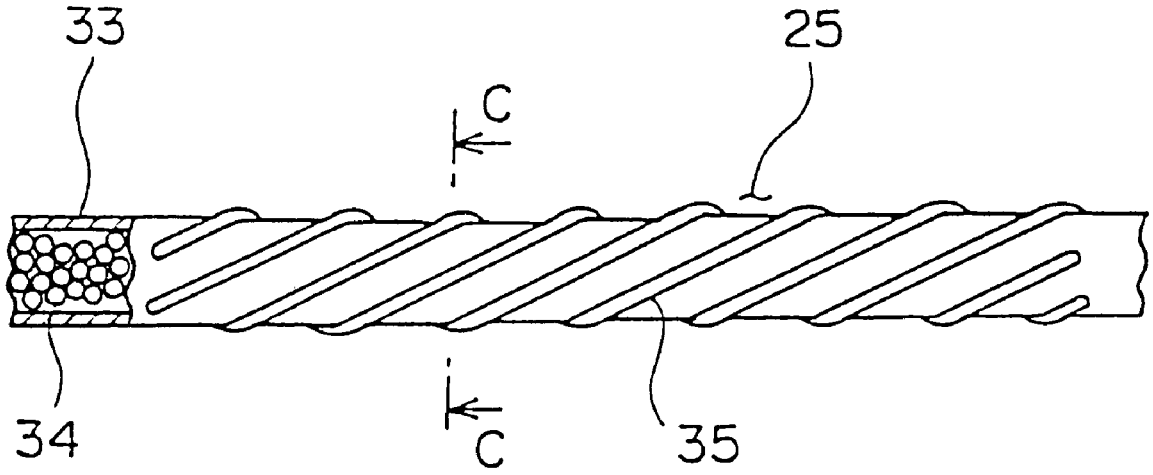
FIG. 3 is a detailed view of the link bar 25 of FIG. 2(*a*), wherein FIG. 3(*a*) is a partially cut out side view and FIG. 3(*b*) is a transverse cross sectional view shown in the arrow C—C direction of FIG. 3(*a*).
Figure 3B:
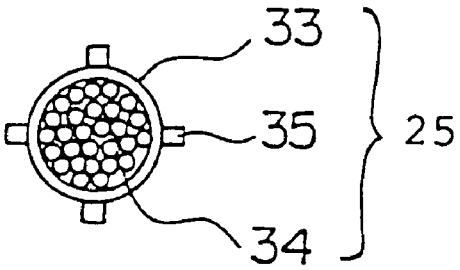

Also, as shown in FIGS. 3(*a*) and 3(*b*) , the link bar 25, except both end portions thereof connected to the link mechanisms 26, is formed of a tubular member 33, and steel balls 34 are filled herein. Further, on an outer circumferential surface of the link bar 25, a spiral rib 35 projects and extends at an inclined relative to a central axis of the tubular member 33.

In the by-pass valve device of the present embodiment mentioned above, the driven shaft 21 which would otherwise interfere with the obstructions of the turbine casing horizontal flange 013 and the like provided on the outer side of the turbine casing 010 is made shorter so as to be placed within the turbine casing 010. The adjacent main driving shaft 23 which is adjacent to the driven shaft 21 and does not interfere with the obstructions even if it projects outside of the turbine casing 010 is linked to the driven shaft 21 via the link bar 25 so as to remove a drive source for rotating the driven shaft 21.

Thus, even if the driven shaft 21 in the drive shaft 09 does not project outside of the turbine casing 010, the driven by-pass valve 20 can be operated to be opened and closed and mere are less restrictions in the outside shape of the turbine casing 010. This results in a wider freedom of the plant arrangement comprising the gas turbine combustor, while in the prior art, the opting and closing adjustment of the driven by-pass valve 20 has been impossible during the operation due to restrictions in the outside shape of the turbine casing 010. Hence, according to the present embodiment, the mixing ratio of the fuel F and the compressed air PA can be made uniform in the combustion area of each of the combustor tail tubes 05 provided along the circumferential direction of the turbine casing 010 so that a favorable combustion can be effected to enhance the combustion efficiency, and an output as a whole of the plant can be increased.

In the prior art, all the drive shafts 09 for opening and closing the by-pass valves 08 are provided radially, because the combustor tail tubes 05 are arranged along the circa direction of the turbine casing 010. In the present embodiment, however, only the driven shaft 21 is biased so as to be in parallel with the adjacent main driving shaft 23 which is provided adjacent to the driven shaft 21, and the rotation of the driven shaft 21 and tit of the adjacent main driving shaft 23 are done in the mutually parallel planes. That is, the link mechanism 26 can be made in a single link type consisting of the driving levers 27 and the connecting members 31. Hence, the device can have a simple construction having a high reliability.

Further, the link bar 25 has the bent portion so that the main driving by-pass valve 22 and the driven by-pass valve 20 do not need to change position and the driven shaft 25 can have the shortest length. By this arrangement, and also by the arrangement in which the driven shaft 21 and the adjacent man driving shaft 23 are made in parallel with each other, the load of the adjacent main driving shaft 23 for rotating the driven shaft 25 can be minimized as needed.

By employing the link mechanism 26 for driving the driven by-pass valve 20 as the inner link mechanism to be placed in the turbine casing 010, the driven by-pass valve 20 can be operated smoothly to be opened and closed regardless of the outside structural restrictions of the turbine casing 010.

On the other hand, because the link mechanism 26 placed in the turbine casing 010 is used for a rotating machine, such as a gas turbine, there is a worry of abrasion or damage thereof due to vibration. Moreover, as the device is exposed to the compressed air PA flowing as fast as about 50 m/s, there may arise a problem of resonance with Karman vortices around the link bar 25.

Thus, the spring 28 is provided in the driving lever 27 of the link mechanism 26 so as to press the bushing inserted into the pivotal portion of the connecting member 31 via the spring seat 29 so that a vibration control and abrasion control for the link mechanism 26 can be attained.

Also, in order to avoid the resonance with Karman vortices around the link bar 25, the rib 35 is provided around the link bar 25 so as to prevent generation of Karman vortices. Moreover, the steel balls 34 are filled in the tubular member of the link bar 25 so that a damping effect due to friction forces thereof may be obtained. Thus, countermeasures for avoiding the resonance with Karman vortices and for damping the vibration transmitted from outside can be realized.

Figure 4A:
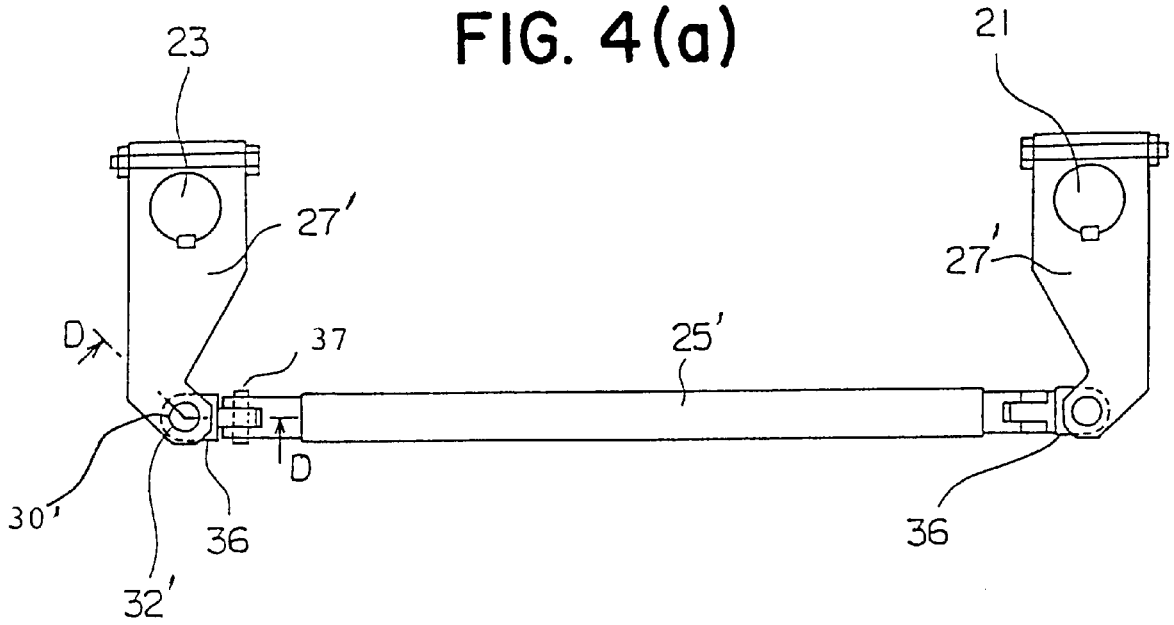
FIG. 4 is an explanatory view of a gas turbine combustor by-pass valve device of a second embodiment according to the present invention, which shows a detailed view of a link mechanism 26' for linking the adjacent main driving shaft 23 and the driven shaft 21 via a link bar 25', wherein FIG. 4(*a*) is a plan view seen in the same direction as indicated by arrow A'—A' of FIG. 1, and FIG. 4(*b*) is a side view seen in arrow D—D direction of FIG. 4(*a*).
Figure 4B:
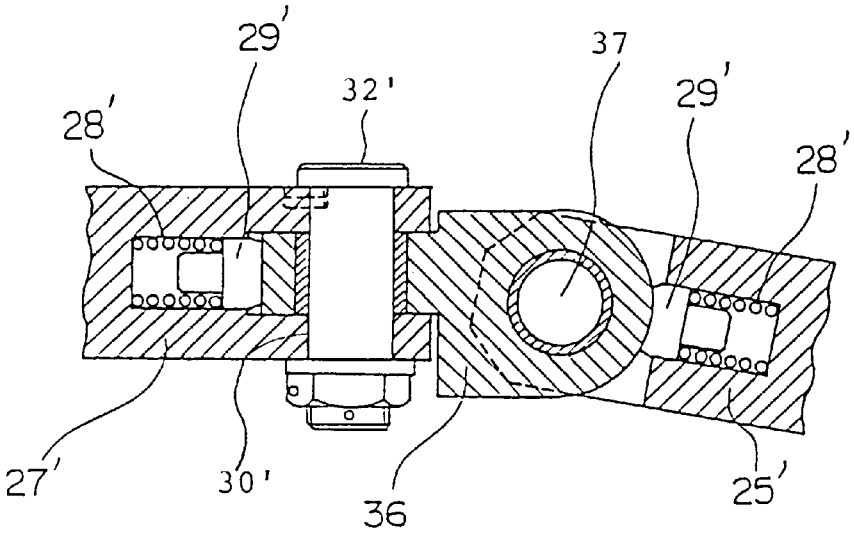

FIG. 4 is an explanatory view of a gas turbine combustor by-pass valve device of a second embodiment according to the present invention, which shows a detailed view of a link mechanism 26' for linking the adjacent main driving shaft 23 and the driven shaft 21 via a link bar 25'. FIG. 4(*a*) is a plan view seen in the same direction as arrow A'—A' of FIG. 1, and FIG. 4(*b*) is a side view seen in arrow D—D direction of FIG. 4(*a*).

As shown in FIG. 4, like in the first embodiment, in order to drive the driven by-pass valve 20 provided in the circumferential directional position within the turbine casing 010 in the place where the turbine casing horizontal flange 013 and the drive shaft 09 for opening and closing the by-pass valve 08 interfere with each other, the driven shaft 21 for opening and closing the driven by-pass valve is made shorter so as to be placed in the turbine casing 010. The driven shaft 21 is linked via a link bar 25' to the adjacent main driving shaft 23 which is provided adjacently to the driven shaft 21 in the circumferential directional position where there is no interference with the turbine casing horizontal flange 013. Therefore, opening and closing of the driven by-pass valve 20 becomes possible.

Also, the adjacent main driving shaft 23 and the link bar 25, are linked together via a driving lever 27, and an intermediate joint 36. The driven shaft 21 and the link bar 25' are likewise linked together via her driving lever 27, and intermediate joint 36. The driving lever 27, and the intermediate joint 36 are connected together via a pivot pin 32, and the intermediate joint 36 and the link bar 25, are connected together via a rotary pin 37.

For the purpose of reducing the vibration and abrasion, like in the first embodiment, a spring 28' is inserted into a spring holding section bored in the driving lever 27' so as to open into a pivot pin hole 30' so that a spring seat 29, is pressed toward a pivot pin 32, to press the intermediate joint 36. In the present embodiment, there is also bored the spring holding section in the link bar 25, in the pivotal portion between the intermediate joint 36 and the link bar 25', and the spring 28' is inserted thereinto so as to press the intermediate joint 36 via the spring seat 29'.

That is, in the present embodiment, the link mechanism 26, is made in an inner double link type, and the reason therefor is that the link bar 25, is located in a place where the air flows in turbulences as fast as about 50 m/s and there is a need to avoid resonance with Karman vortices. Moreover, in order to avoid resonance with Karman vortices, the link bar 25, is also made of a tubular member and is provided with the same rib 35 all around and is filled with the steel balls 34 therein, like in the case of the first embodiment shown in FIG. 3.

In the by-pass valve device of the present second embodiment, like in the first embodiment, the driven shaft 21 which would otherwise interfere with the obstructions of the turbine casing horizontal flange 013 and the like provided on the outer side of the turbine casing 010 is made shorter so as to be positioned within the turbine casing 010. The adjacent man driving shaft 23 which is provided adjacently to the driven shaft 21 so as not to interfere with the obstructions even if it projects outside of the turbine casing 010 is linked to the driven shaft 21 via the link bar 25' so as to provide a drive source for rotating the driven shaft 21.

Thus, restrictions in the outside shape of the turbine casing 010 are made minimum, which results in a wider freedom of the plant arrangement comprising the gas turbine combustor. Further, the mixing ratio of the fuel F and the compressed air PA can be made uniform in the combustion area of each of the combustor tail tubes 05 provided along the circumferential direction of the turbine casing 010. Thus, a favorable combustion can be effected to enhance the combustion efficiency, and an output as a whole of the plant can be increased.

Furthermore, in the present embodiment, the drive shafts 09 for opening and closing the by-pass valves 08 are provided to extend radially because the combustor tail tubes 05 are arranged along the circumferential direction of the turbine casing 010.

Accordingly, the rotational movement of the adjacent main driving shaft 23 is transmitted to the driven shaft 21 via one link mechanism constructed by the driving levers 271, which are fixed at their ends to the adjacent main driving shaft 23 and the driven shaft 21, respectively, as well as by the intermediate joints 36. The rotational movement in the circumferential direction of the turbine casing 010 is undertaken by another link mechanism constructed by the rotary pin 37 for connecting the intermediate joint 36 and the link bar 25' pivotally.

Thus, by employing such an inner double link mechanism, the drive shafts 09, arranged radially, consisting of the main driving shaft 24, the adjacent main driving shaft 23 and the driven shaft 21 can be driven smoothly regardless of the outside structural restrictions of the turbine casing 010.

Further, as all the by-pass valves 08 can be opened and closed in the same direction, not only the main driving by-pass valve 22 driven by the main driving shaft 24 and the adjacent main driving shaft 23 but also the driven by-pass valve 20 driven by the driven shaft 21 can supply the same uniform air flow into the combustor tail tube 07. Hence, the mixing ratio of the fuel F and the compressed air PA can be made uniform in the combustion area of each of the combustor tail tubes 05 provided along the circumferential direction of the turbine casing 010. Thus, a favorable combustion can be effected to enhance the combustion efficiency, a an output as a whole of the plant can be increased.

Figure 5:
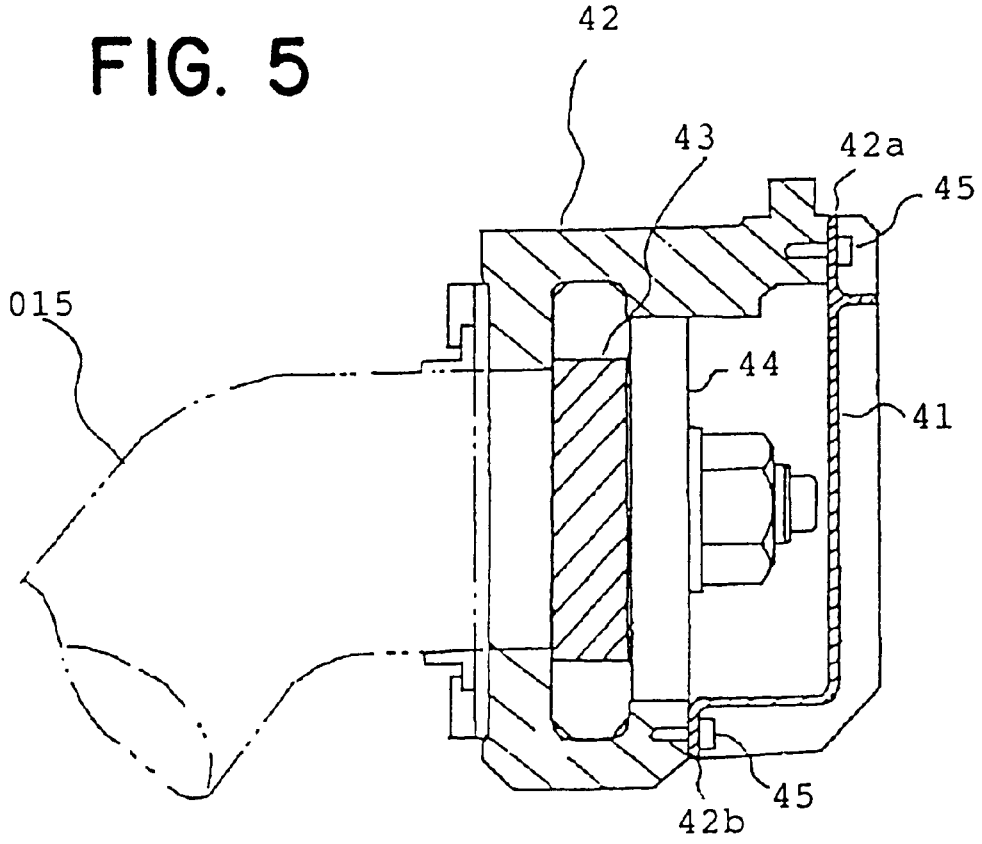
FIG. 5 is a cross sectional side view of a gas turbine combustor by-pass valve device of a third embodiment according to the present invention, which shows a mounting portion of a punching metal as one example of a perforated plate.
Figure 6:
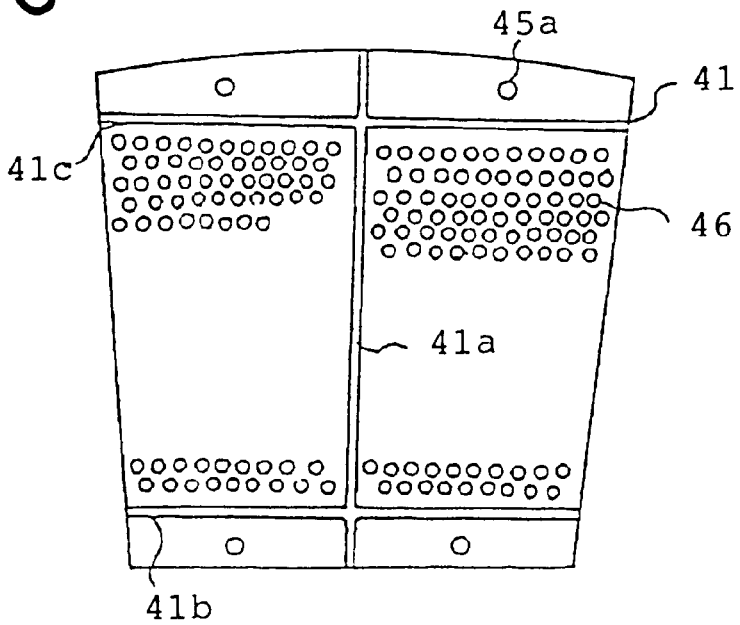
FIG. 6 is a front view of the punching metal of FIG. 5.
Figure 7:
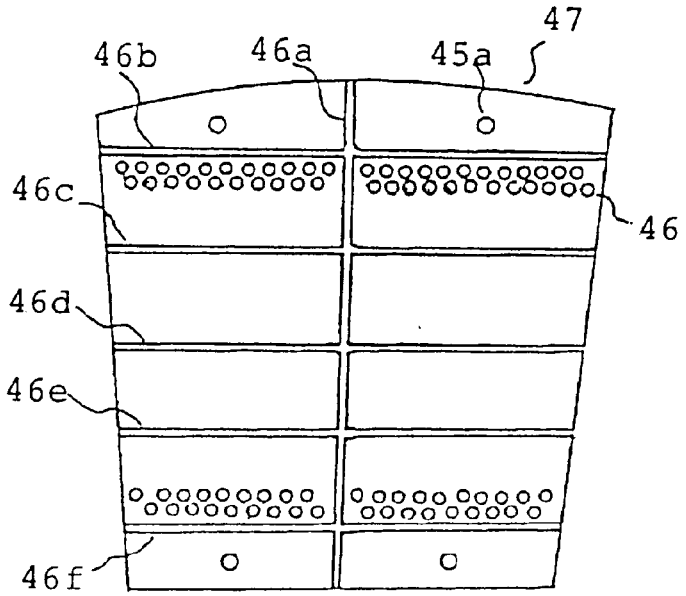
FIG. 7 is a front view showing another example of application of the punching metal according to the present invention.

FIG. 5 is a cross sectional side view of a gas turbine combustor by-pass valve device of a third embodiment according to the present invention, which shows a mounting portion of a punching metal as one example of a perforated plate. FIG. 6 is a front view of the punching metal of FIG. 5, and FIG. 7 is a front view showing another example of application of the punching metal according to the present invention.

In FIG. 5, numeral 015 designates a by-pass duct connecting to a gas turbine combustor and having its entrance portion connected to a fixed ring 42. Numeral 43 designates a movable ring disposed within the fixed ring 42. The movable ring 43 is provided with a by-pass valve 08 (FIG. 8), and when the movable ring 43 rotates, it operates the by-pass valve 08 so that an opening of the by-pass duct 015 may be opened and closed. For the entire arrangement surrounding this portion, reference is to be made to FIG. 8.

Numeral 44 designates a guide roller, which supports the movable ring 43 rotatably. Numeral 41 designates a perforated plate, a punching metal for example, which is fitted to an end face 42*a*, 42*b* via a bolt 45 so that a front side portion of the by-pass valve 08 of the movable ring 43 may be covered by the perforated plate 41. In the perforated plate 41, there are bored a multiplicity of holes 46 (FIG. 6) of such a size that air may flow through without resistance but foreign matters mixed in the flow of metal fractions, bolts, nuts or the like may not pass through. The shape of the holes may be a circle, an ellipse, a slit-like aperture or a combination thereof. If a thickness is required for the perforated plate, a formed metal perforated plate is employed and for a smaller thickness, a punching metal will be preferable because of workability.

In FIG. 6, the perforated plate 41, that is, a punching metal 41 in this case, is provided with a reinforcing rib 41*a*, 41*b*, 41*c*, which is formed together integrally or fitted by welding. Material of the punching metal 41 is the same as that of the by-pass valve 08, and the thickness thereof is about 5 mm. The diameter of each of the holes 46 is about 10 mm so that foreign may not pass through, and the holes 46 are arranged with a hole to hole pitch of about 10 to 13 mm. The diameter of the movable ring 43 and thus size of the punching metal 41 are decided according to the size of the gas turbine plant. Numeral 45*a* designates a bolt hole, through which the punching metal 41 is fixed to the end face 42*a*, 42*b* of the fixed ring 42 by the bolt 45 as shown in FIG. 5.

In FIG. 7, or example of the punching metal is shown in which the punching metal 47 is of the same size and shape as those of the example of FIG. 6, but is provided with more reinforcing ribs so as to have a better vibration resistant ability. That is, in the punching metal 47, there are provided a longitudinal reinforcing rib 46*a* and a plurality of lateral ribs 46*b*, 46*c*, 46*d*, 46*e*, 46*f* crossing the rib 46*a* orthogonally and amounting to five pieces of ribs, while in the example of FIG. 5, there are two ribs 41*b* and 41*c*.

Figure 8:
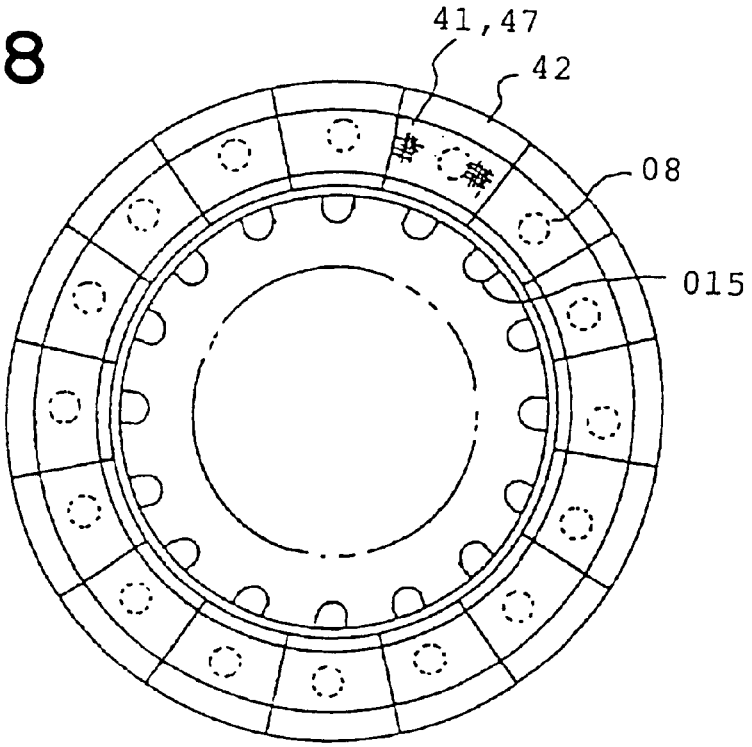

FIG. 8 is an entire front view of a portion in a gas turbine casing where the punching metal 41 or 47 is arranged, wherein this FIG. 8 is seen from a gas turbine combustion gas path side toward a combustor side. As seen there, the punching metal 41, 47 is fitted to the end face of the ring-like fixed ring 42 so as to cover the, circumferential directional entire end face portion of the fixed ring 42. In the example shown in FIG. 8, the punching metal 41, 47 is provided so as to correspond to each of the by-pass valves 08 one to one.

It is to be noted that the number of pieces of the punching metals and the shape thereof are not limited to those shown in FIGS. 6 and 7 but may be made in an arc form in which several pieces thereof are connected in series or in which a single arcuate punching metal is used so as to cover a plurality of adjacent by-pass valves 08. That is, the number and shape of the perforated plates 41 may be decided appropriately according to the conditions of strength, state of vibration, etc.

Also, the fitting position of the perforated metal 41 may be a front side or a back side of the by-pass valve 08, but if it is provided on the front side of the by-pass valve 08, it will be preferable in terms of the effect thereof as the foreign matters are prevented from passing through the by-pass valve 08 so as not to damage the by-pass valve 08, and discharge of the foreign matters is facilitated.

In the present gas turbine combustor by-pass valve device constructed as mentioned above, in a rated operation time of the gas turbine, an inlet opening portion of the by-pass duct 015 is closed by the by-pass valve 08. However, if fuel is reduced for a low load operation and still a large amount of combustion air is supplied, then there arises a problem of flame failure of a nozzle. Hence, in this case, a pre-mixture air for combustion is reduced and the by-pass valve 08 is opened instead so that air is supplied into the combustion tail tube 05 through the by-pass duct 015. At this time, the movable ring 43 is rotated by a drive mechanism (not shown) so as to open the by-pass valve 08.

In the above, the air passes through the holes 46 of the punching metal 41, 47 and further through the by-pass valve 08 to flow into the by-pass duct 015 to be then led into the combustor tail tube 05. In this process of air flow, foreign matters mixed in the air flow are prevented by the multiplicity of the holes 46 from entering the by-pass duct 015. Hence, there is no case of foreign matters entering the gas turbine combustion gas path, and a safe operation is ensured.

In the present embodiment, description has been made of the example where the punching metal 41, 47 is applied to a gas turbine combustor by-pass valve device in which the by-pass valve 08 is operated by the rotation of the movable ring 43 so as to open and close the opening potion of the by-pass duct 015. Needless to mention, the present embodiment may also be applied to a gas turbine combustor by-pass valve device of a type in which a valve element of a by-pass valve provided on a by-pass duct inlet is rotated to open and close a by-pass duct.

It is understood that the invention is not limited to the particular construction and arrangement herein described and illustrated but embraces such modified forms thereof as come within the scope of the appended claims.

What is claimed is:

1. A gas turbine combustor apparatus comprising:

a turbine casing;

a plurality of combustor tail tubes arranged along a circumference of said turbine casing;

a combustion area downstream of each of said plurality of combustor tail tubes;

a driving device on an outer side of said turbine casing;

a plurality of main by-pass valves provided at each of a first group of said combustor tail tubes for controlling an air flow rate for combustion of fuel supplied into said combustion area downstream of each of said first group of combustor tail tubes, each of said main by-pass valves including a valve body and a driving shaft having a proximal end connected to said valve body and having a distal end projecting through said turbine casing to said outer side of said turbine casing and being connected to said driving device such that said driving device is operable to open and close each of said main by-pass valves via sad driving shaft;

a plurality of driven by-pass valves provided at each of a second group of said combustor tail tubes for controlling an air flow rate for combustion of fuel supplied into said combustion area downstream of each of aid second group of combustor tail tubes, each of said driven by-pass valves including a valve body and a driven shaft having a proximal end connected to said valve body and having a distal end positioned within said turbine casing; and a plurality of link mechanisms disposed in said turbine casing, each of said link mechanisms including a first driving lever, a second driving lever, a first connecting member, a second connecting member, and a link bar having a first end and a second end, said first driving lever of each of said link mechanims having a proximal end fixed to said driven shaft of one of said driven by-pass valves and having a distal end pivotally connected to said first connecting member, said distal end of said first driving lever having a spring arranged therein, said second driving lever of each of said link mechanisms having a proximal end fixed to said driving shaft of an adjacent one of said main by-pass valves positioned adjacent to said one of said driven by-pass valves and having a distal end pivotally connected to said second connecting member, said distal end of said second driving lever having a spring arranged therein, said first end of said link bar of each of said link mechanisms being connected to said first connecting member, and said second end of said link bar being connected to said second connecting member so as to transmit a rotary movement of said driving shaft of said adjacent one of said main by-pass valves to said driven shaft of said one of said driven by-pass valves, whereby said driving shaft of said adjacent one of said main by-pass valves is operable to open and close said one of said driven by-pass valves in synchronism with the opening and closing of said adjacent one of said main by-pass valves.

2. The apparatus of claim 1, wherein said outer side of said turbine casing includes obstructions at impede positions along sad circumference;

each of said driven by-pass valves being located at positions within said turbine casing corroding to sad interference positions along said circumference of said turbine casing whereat an outer side of said turbine casing includes said obstructions; and each of said main by-pass valves being located at positions within said turbine casing corresponding to positions along said circumference of said turbine casing whereat an outer side of said turbine casing is free of said obstructions.

3. The apparatus of claim 1, wherein said driven shaft of each of said driven by-pass valves is parallel to said driving shaft of an adjacent one of said main by-pass valves.

4. The apparatus of claim 1, wherein said link bar of each of said link mechanisms has a bent portion between said first end and said second end.

5. The apparatus of claim 1, wherein said link bar of each of said link mechanisms comprises a tubular member containing steel balls therein, and includes an outer surface having a rib arranged at an incline with respect to an axial direction of said link bar.

6. The apparatus of claim 1, wherein each of said link mechanisms further includes a first intermediate joint and a second intermediate joint, said first intermediate joint having a first end pivotally connected via a pivot pin to said distal end of said first driving lever such that said first driving lever and said first intermediate joint can move relative to each other corresponding to a rotary movement of said drive shaft, and said first intermediate joint having a second end pivotally connected via a rotary pin to said first end of said link bar; and said second intermediate joint having a first end pivotally connected via a pivot pin to said distal end of said second driving lever such that said second driving lever and said second intermediate joint can move relative to each other corresponding to a rotary movement of said drive shaft, and said second intermediate joint having a second end pivotally connected via a rotary pin to said second end of said link bar.

* * * * *